United States Patent [19]

Jackman et al.

[11] 4,279,650

[45] Jul. 21, 1981

[54] TITANIUM BEARING ADDITION ALLOYS

[75] Inventors: Joseph R. Jackman, New Castle; Wayne E. Hanna, Ellwood City, both of Pa.

[73] Assignee: Reactive Metals & Alloys Corporation, West Pittsburg, Pa.

[21] Appl. No.: 130,605

[22] Filed: Mar. 17, 1980

[51] Int. Cl.[3] ..... C22C 14/00

[52] U.S. Cl. ..... 75/175.5; 75/57

[58] Field of Search ..... 75/53, 57, 58, 175.5, 75/134 F; 148/32

[56] References Cited

U.S. PATENT DOCUMENTS

| | | | |
|---|---|---|---|
| 2,464,836 | 3/1949 | Thomas, Jr. et al. | 75/134 F |
| 2,666,698 | 1/1954 | Dickinson et al. | 75/175.5 |
| 2,721,137 | 10/1955 | Pitler | 75/175.5 |
| 2,781,261 | 2/1957 | Kamlet | 75/175.5 |
| 2,880,087 | 3/1959 | Jaffee | 75/175.5 |
| 2,884,687 | 5/1959 | Thomson et al. | 75/175.5 |
| 3,113,227 | 12/1963 | Bomberger et al. | 75/175.5 |
| 3,410,679 | 11/1968 | Pardo | 75/175.5 |

FOREIGN PATENT DOCUMENTS

| | | | |
|---|---|---|---|
| 616321 | 7/1978 | U.S.S.R. | 75/175.5 |

OTHER PUBLICATIONS

*Magnesium In Steel Making* Armco Steel, Inc., Eastern Division, (No Date) pp. 1 to 62.

*Primary Examiner*—Michael L. Lewis

*Attorney, Agent, or Firm*—Buell, Blenko, Ziesenheim & Beck

[57] ABSTRACT

A new and improved titanium bearing master alloy with aluminum and iron is provided consisting essentially of 54 to 60% Ti, 15–22% Al, 17–22% Fe, 5% max. Si, 1% max. Va. 0.25% max. Si, 0.75% max. $N_2$ and 0.50% max. C.

2 Claims, No Drawings

TITANIUM BEARING ADDITION ALLOYS

The present invention relates to titanium bearing addition alloys and more particularly to a ferro titanium master alloy which is low in carbon and other residual elements and has a lower melting point than conventional 70–30 ferro titanium.

Ferro titanium is utilized in the manufacture of steel and particularly stainless steel as a deoxidizing agent and as an alloying element. It is particularly used in stainless steels such as 409 alloy for fabrication of mufflers and the like which are subject to heat and the corrosive products of combustion of hydrocarbons.

In general, the ferro titanium presently available is an alloy of 70% titanium and 30% iron made by melting titanium aircraft alloys having about 90% Ti, 6% Al and 4% Va with iron to produce the desired alloy. This product has a variety of undesirable characteristics. Its melting point is relatively high, its vanadium, carbon, nitrogen and tin contents are usually undesirably high and limit the quantities which can be added. Moreover, its price is subject to wide fluctuations dependent upon the availability of satisfactory titanium scrap from the aircraft industry. This problem is recognized and a method proposed for making this same alloy from previously unusable titanium shavings, borings, turnings, chips and similar fine particle titanium alloys appears in U.S. Pat. No. 3,410,679.

Applicants have discovered a titanium bearing master alloy which is cheaper to use in the steel industry, has a lower melting point and is substantially free from undesirable residual elements than the conventional 70–30 ferro titanium while at the same time being free from the vagaries of the aircraft titanium alloy scrap market.

We have discovered a new titanium bearing master alloy having the broad composition:

| | |
|---|---|
| Titanium | 54% to 60% |
| Aluminum | 15% to 22% |
| Iron | 17% to 22% |
| Silicon | 5% max. |
| Vanadium | 1% max. |
| Tin | 0.25% max. |
| Nitrogen | 0.75% max. |
| Carbon | 0.5% max. |

Preferably the alloy is made to a nominal analysis of:

| | |
|---|---|
| Titanium | about 57% |
| Aluminum | about 17.5% |
| Iron | about 20% |
| Silicon | about 1.5% |
| Vanadium | about 0.5% |
| Tin | about 0.15% |
| Nitrogen | about 0.5% |
| Carbon | about 0.2% |

This alloy can be made from pre-reduced Ilmenite thus removing it from the fluctuations of the scrap market or it could be made from selected scrap with iron and aluminum additions to produce the desired analysis.

This product has many advantages over the conventional 70–30 ferro alloy. First, it has a lower melting point and thus is more rapidly dissolved in the molten steel on addition to the ladle. Second, it has built-in aluminum protection for the titanium and reduces the losses of titanium through oxidation in the molten bath. Third, it eliminates the need for a separate aluminum addition together with its attendant costs. Fourth, it substantially eliminates the residual elements nitrogen, carbon, tin and oxygen which have limited the titanium addition through conventional 70–30 ferro titanium. Fifth, it drastically reduces the amount of vanadium present in the alloy and eliminates another variable which affected the permissable ferro titanium addition by 70–30 alloy. Finally, the alloy of the present invention is cheaper to use and it is not subject to wide market fluctuations.

In the foregoing specifications we have set out certain preferred practices and embodiments of our invention; however, it will be understood that this invention may be otherwise embodied within the scope of the following claims.

We claim:

1. A new and improved titanium bearing master alloy consisting essentially by weight of about 54% to 60% titanium, about 15% to 22% aluminum, about 17% to 22% iron, 5% max. silicon, 1% max. vanadium, 0.25% max. tin, 0.75% max. nitrogen and 0.50% max. carbon.

2. A titanium bearing master alloy as claimed in claim 1 having the composition about 57% titanium, about 17.5% aluminum, about 20% iron, about 1.5% silicon, about 0.5% vanadium, about 0.15% tin, about 0.5% nitrogen and about 0.2% carbon.

* * * * *